US006302748B1

(12) United States Patent
Xu et al.

(10) Patent No.: US 6,302,748 B1
(45) Date of Patent: Oct. 16, 2001

(54) ELECTRICAL CONNECTOR HAVING AN IMPROVED HOUSING WITH RELIABLE CONTACT RECEIVING CAVITIES

(75) Inventors: Xiang Xu; XinHai Xiang, both of Kunsan (CN)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 09/470,489

(22) Filed: Dec. 22, 1999

(51) Int. Cl.[7] ..... H01R 13/428
(52) U.S. Cl. ..... 439/752.5; 439/751
(58) Field of Search ..... 439/752.5, 733.1, 439/752, 751

(56) References Cited

U.S. PATENT DOCUMENTS 5,478,263 * 12/1995 Kato ..... 439/752
5,516,308 * 5/1996 Yamanashi ..... 439/752
5,567,185 * 10/1996 Henderson et al. ..... 439/751
5,609,503 * 3/1997 Tsuji et al. ..... 439/733.1
5,664,969 * 9/1997 Peterson et al. ..... 439/752.5

* cited by examiner

*Primary Examiner*—Gary Paumen
(74) *Attorney, Agent, or Firm*—We Te Chung

(57) ABSTRACT

An electrical connector comprises an insulative housing defining a number of contact receiving cavities and a same number of contacts respectively received in the contact receiving cavities. The housing includes a number of blocks each extending into a corresponding contact receiving cavity, thereby defining two guiding grooves spaced by the corresponding block. Each contact comprises two engaging flanges fixed in corresponding guiding grooves and being biased to a corresponding block, thereby securing the contact in the corresponding contact receiving cavity.

1 Claim, 6 Drawing Sheets

ELECTRICAL CONNECTOR HAVING AN IMPROVED HOUSING WITH RELIABLE CONTACT RECEIVING CAVITIES

BACKGROUND OF THE INVENTION

1. Field of the Invention

The present invention relates to a connector, and particularly to a connector having an improved housing with a plurality of reliable contact receiving cavities to securely receive a corresponding number of contacts therein.

2. Description of the Prior Art

Referring to FIGS. 3 and 3A, a conventional connector 8 comprises an insulative housing 80 and a plurality of contacts 82 received in the housing 80. The housing defines a plurality of contact receiving cavities 84 each having a generally rectangular shape. Each contact 82 comprises a first end 86, a second end 88 and a retention portion 90 therebetween. The retention portion 90 forms a pair of engaging flanges 92 which interferentially bias against a periphery of a corresponding contact receiving cavity 84 thereby securing the contact 82 in the housing 80. Similar electrical connectors are also disclosed in U.S. Pat. Nos. 4,717,354 and 5,175,928.

However, since the contact receiving cavities 84 are featureless, and therefore have no guiding means, when the contacts 82 are assembled into the cavities 84, the contacts 82 may be positioned incorrectly. Therefore, when the connector 8 mates with a mating connector (not shown), the contacts 82 may be disengaged from the housing 80 by forces exerted by the terminals of the mating connector. Hence, an improved electrical connector is required to overcome the disadvantages of the prior art.

BRIEF SUMMARY OF THE INVENTION

An object of the present invention is to provide an electrical connector comprising an insulative housing and a plurality of contacts wherein the insulative housing comprises a plurality of improved contact receiving cavities to securely receive the plurality of contacts therein.

To fulfil the above object, an electrical connector of the present invention comprises an insulative housing defining a number of contact receiving cavities and a same number of contacts respectively received in the contact receiving cavities. The housing includes a number of blocks each extending into a corresponding contact receiving cavity, thereby defining two guiding grooves spaced by the corresponding block. Each contact comprises two engaging flanges fixed in corresponding guiding grooves and being biased against corresponding block, thereby securing the contact in the corresponding contact receiving cavity.

Other objects, advantages and novel features of the invention will become more apparent from the following detailed description of the present embodiment when taken in conjunction with the accompanying drawings.

DETAILED DESCRIPTION OF THE INVENTION

Figure 1:
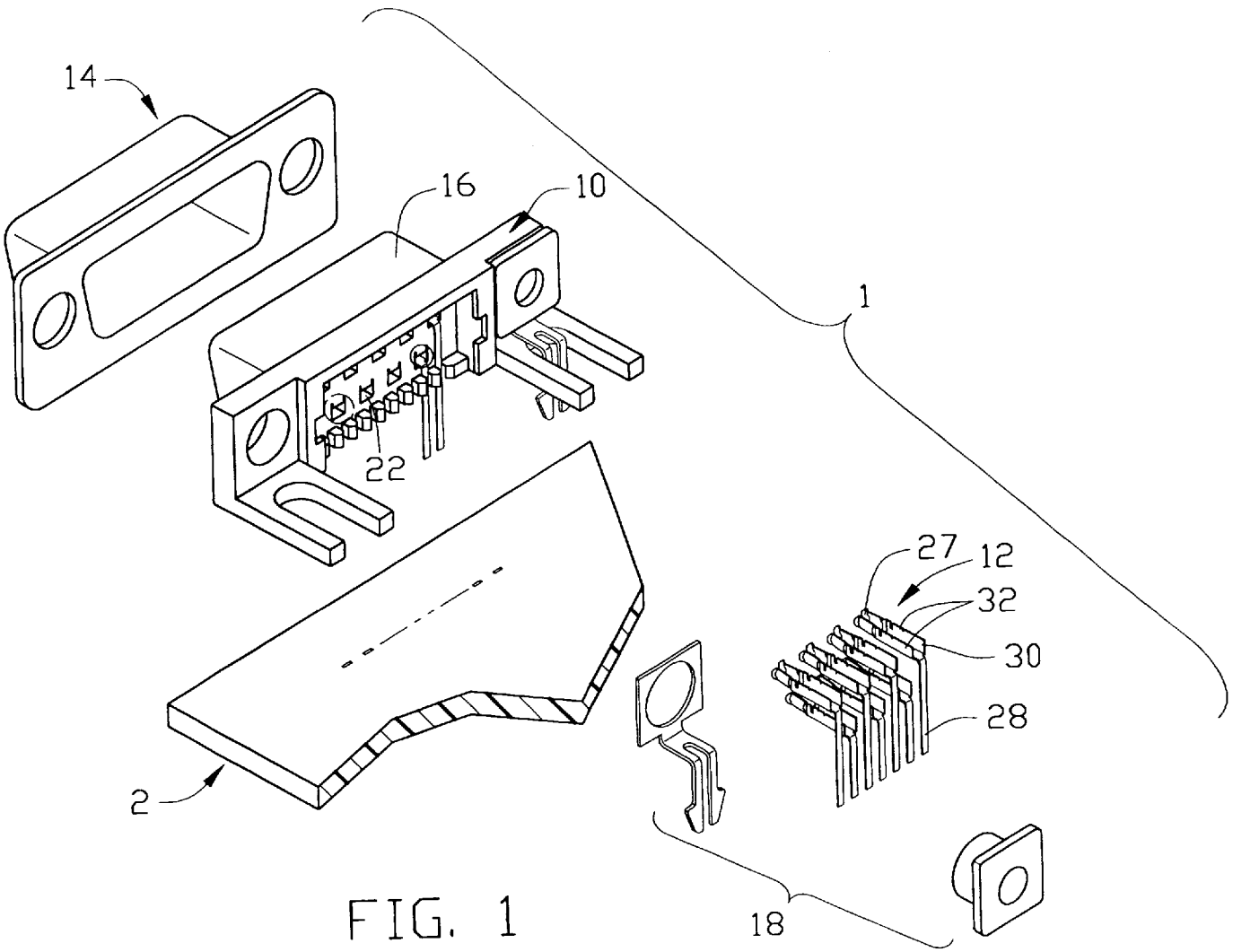
FIG. 1 is an exploded perspective view of an electrical connector in accordance with the present invention.

Referring to FIG. 1, an electrical connector 1 of the present invention comprises an insulative housing 10, a plurality of contacts 12 received in the housing 10, a metallic shroud 14 enclosing a tongue portion 16 of the housing 10 and a pair of locking members 18 for retaining the connector 1 onto a circuit board 2.

Figure 1A:
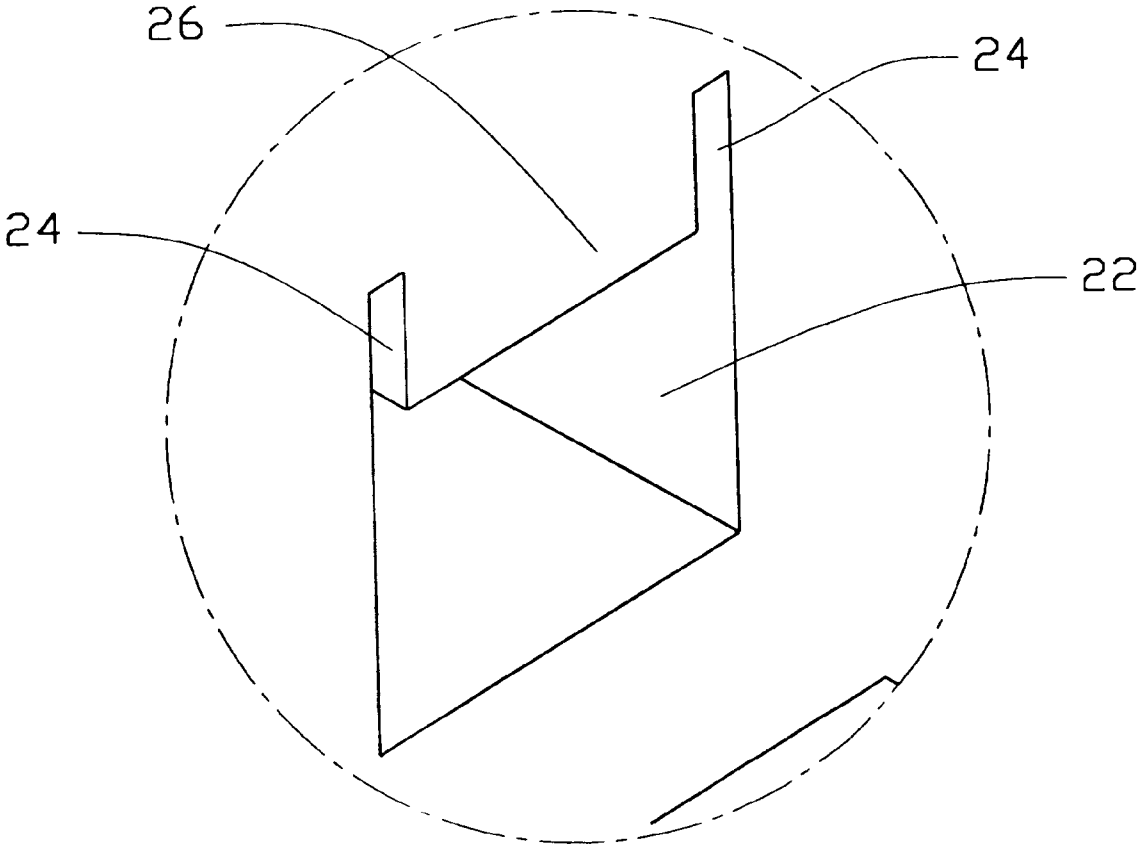
FIG. 1A is a partial and enlarged perspective view of an insulative housing of the electrical connector shown in FIG. 1.

Also referring to FIG. 1A, the housing 10 defines a plurality of contact receiving cavities 22 each of which further define a pair of guiding grooves 24 extending a distance into the housing 10 and being spaced by a block 26 in the housing 10. Each contact 12 comprises a mating portion 27, an opposite mounting portion 28 and a retention portion 30 between the mating and the mounting portions 27, 28. The retention portion 30 comprises a pair of engaging flanges 32 extending substantially higher than other portions of the contact 12 allowing them to interferentially fix with the sides of the housing 10.

Figure 2:
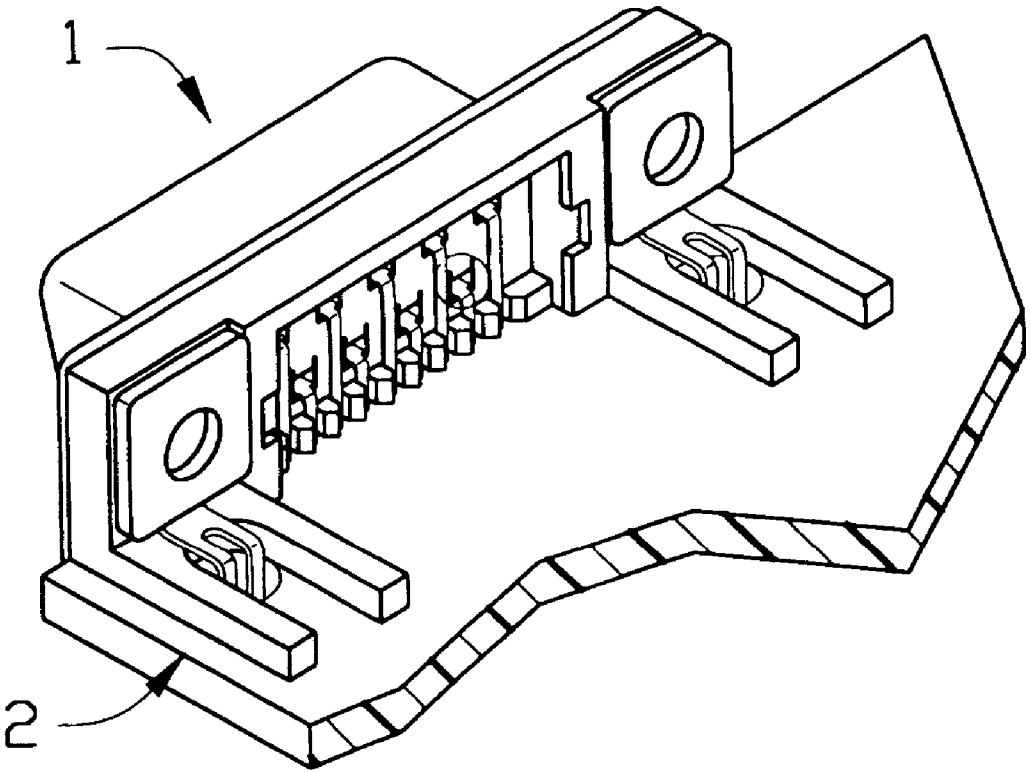
FIG. 2 is an assembled view of FIG. 1.
Figure 2A:
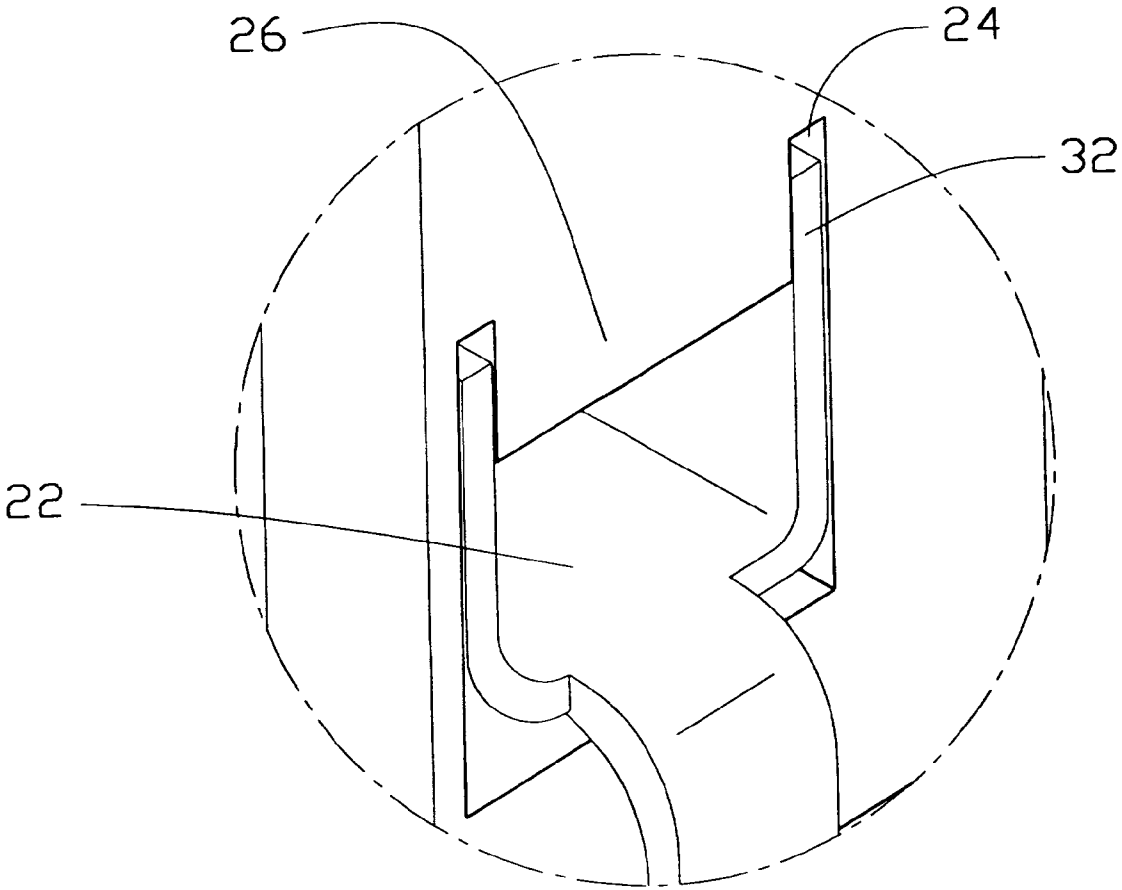
FIG. 2A is a partial and enlarged view of FIG. 2.
Figure 3:
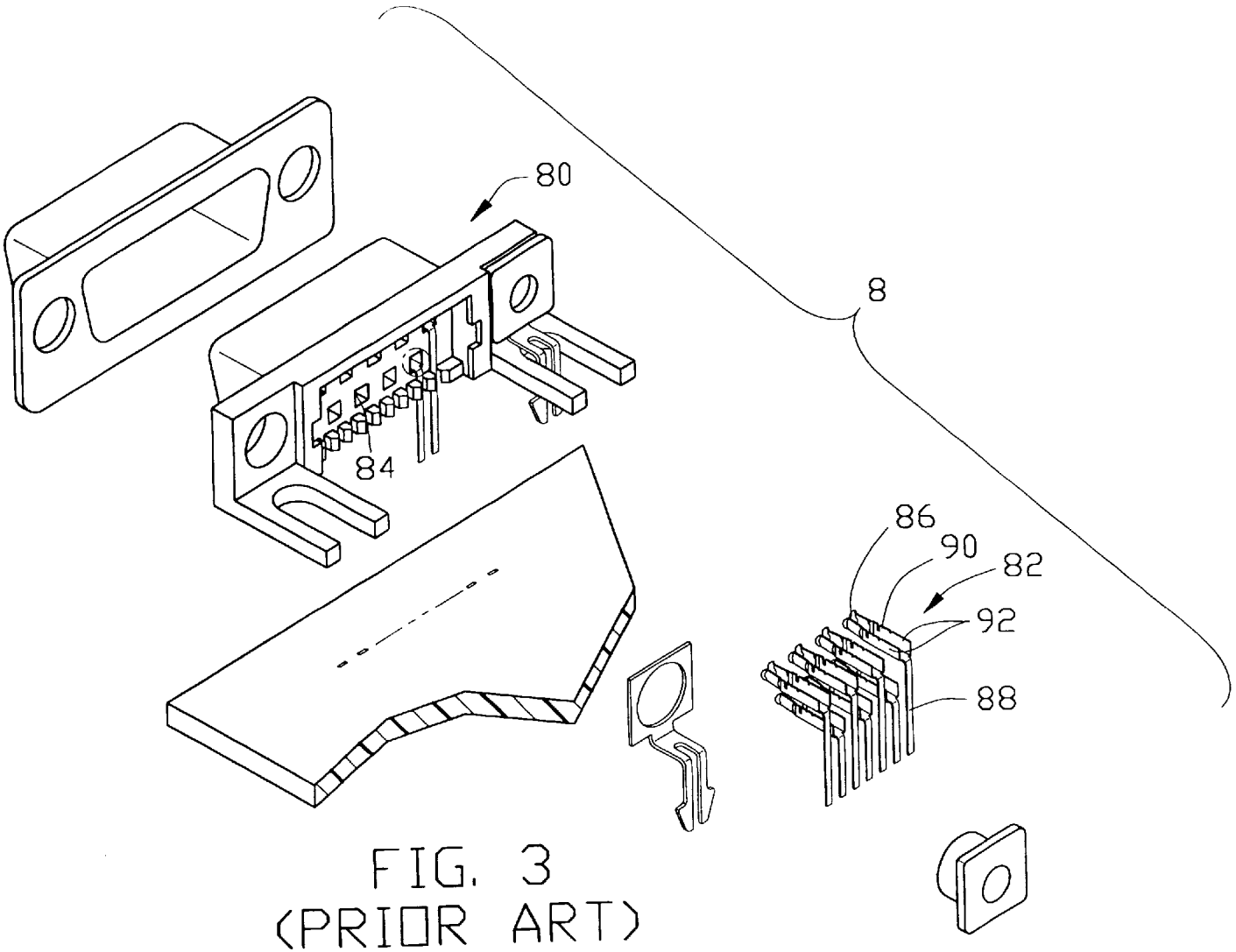
FIG. 3 (PRIOR ART)
FIG. 3 is an exploded perspective view of a conventional electrical connector.
Figure 3A:
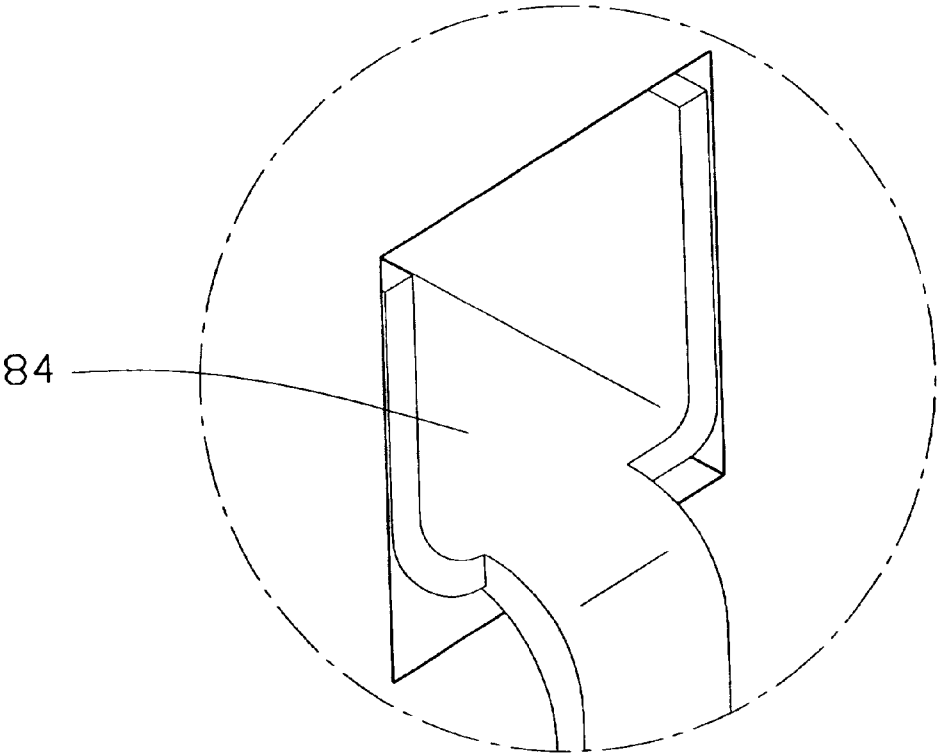
FIG. 3A (PRIOR ART)
FIG. 3A is a partial and enlarged view of FIG. 3.

In assembly, also referring to FIGS. 2 and 2A, the contacts 12 are forwardly assembled into the contact receiving cavities 22 of the housing 10 with the mating portions 27 and the retention portions 30 received in the contact receiving cavities 22. The engaging flanges 32 of each contact 12 are fixedly received in corresponding guiding grooves 24 of the housing 10 and bias against the block 26 whereby the contacts 12 are reliably secured in the corresponding guiding grooves 24.

As clearly shown in FIGS. 1, 1A and 2A, each of the engaging flanges 32 is planar and has no crimples or arches thereon. Each of the guiding grooves 24 has a dimension substantially equal to a thickness of the engaging flange 32 in a transverse direction perpendicular to the front-to-back direction. The dimension of the guiding groove 24 is so designed that the engaging flange 32 may be inserted into the guiding groove 24 by a certain insertion force and provides a required retention force to prevent disengagement of the contact from the contact receiving cavity 22.

Because of the presence of the guiding grooves 24 in the housing 10, the contacts 12 are reliably and correctly arranged in the housing 10. The problems occurring in the prior art such as incorrect positioning of the contacts 12 in the housing 10 and disengagement of the contacts 12 from the housing 10 are overcome.

When closely comparing the contact receiving cavities 22 of the present invention, as described above, with those of the prior art, it is apparent that the guiding grooves 24 are more deeply recessed into the housing 10 from the corresponding contact receiving cavity 22. Therefore, the engaging flanges 32 of the contact 12 must be higher than those of the conventional contact. In an alternative embodiment, the block 26 extends into the contact receiving cavity 22 and the contact receiving cavity 22 has a smaller dimension, whereby the conventional contacts can be used with the present invention.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. An electrical connector comprising:

an insulative housing defining a plurality of contact receiving cavities extending in a front-to-back direction, each contact receiving cavity defining a block extending in the front-to-back direction, a pair of guiding grooves positioned by two sides of the block in the contact receiving cavity; and a plurality of contacts respectively received within the corresponding contact receiving cavities, each contact defining a U-shaped cross-section in a rear portion compliantly abutting against three side walls of the housing in the corresponding contact receiving cavity; wherein a pair of engaging flanges of each of said contacts upwardly extending into the corresponding guiding grooves, respectively, and are biased to press against the block therebetween; and wherein each of the engaging flanges is planar; and wherein each of the guiding grooves has a dimension, measured in a transverse direction perpendicular to the front-to-back direction, substantially equal to a thickness of the engaging flange.

* * * * *